US005626066A

United States Patent [19]

Lallement

[11] Patent Number: 5,626,066

[45] Date of Patent: May 6, 1997

[54] SUCTION DEVICE FOR AN AUTOMATIC CUTTING MACHINE AND A CUTTING METHOD IMPLEMENTING SAID DEVICE

[75] Inventor: Régis Lallement, Cestas, France

[73] Assignee: Lectra Systems, Cestas, France

[21] Appl. No.: 392,894

[22] PCT Filed: Aug. 10, 1993

[86] PCT No.: PCT/FR93/00800

§ 371 Date: Mar. 1, 1995

§ 102(e) Date: Mar. 1, 1995

[87] PCT Pub. No.: WO94/05470

PCT Pub. Date: Mar. 17, 1994

[30] Foreign Application Priority Data

Sep. 1, 1992 [FR] France ..... 92 10455

[51] Int. Cl.[6] ..... B25B 11/00

[52] U.S. Cl. ..... 83/451; 83/100

[58] Field of Search ..... 83/451, 100, 24; 269/21; 137/602, 605; 15/413, 412

[56] References Cited

U.S. PATENT DOCUMENTS

| | | | |
|---|---|---|---|
| 3,598,006 | 8/1971 | Gerber et al. | 83/451 |
| 4,328,726 | 5/1982 | Pearl . | |
| 4,910,968 | 3/1990 | Yamashita et al. . | |
| 5,062,334 | 11/1991 | Killilea . | |
| 5,103,153 | 4/1992 | Droho . | |
| 5,277,092 | 1/1994 | Kinta | 83/100 |
| 5,284,180 | 2/1994 | Guo et al. | 137/488 |
| 5,323,483 | 6/1994 | Baeg | 388/811 |
| 5,435,066 | 7/1995 | Bare et al. | 30/388 |

FOREIGN PATENT DOCUMENTS

| | | |
|---|---|---|
| 2681278 | 3/1993 | France . |
| 2681280 | 3/1993 | France . |
| 289050 | 6/1953 | Switzerland . |

*Primary Examiner*—Kenneth E. Peterson
*Attorney, Agent, or Firm*—Jones & Askew

[57] ABSTRACT

The invention relates to a suction device for holding a stack of sheet material on a cutting table (A) of an automatic cutting machine. The suction device comprises a turbine (4) provided with a suction air inlet circuit (41) level with the cutting zone to establish suction for the purpose of holding the stack on the table, and with an air exhaust circuit (40), the turbine being driven by an electric motor (5) having a fan (15) and an air outlet duct (50), the electric drive motor (5) may vary its speed of rotation to adjust the amount of suction.

4 Claims, 2 Drawing Sheets

FIG_2
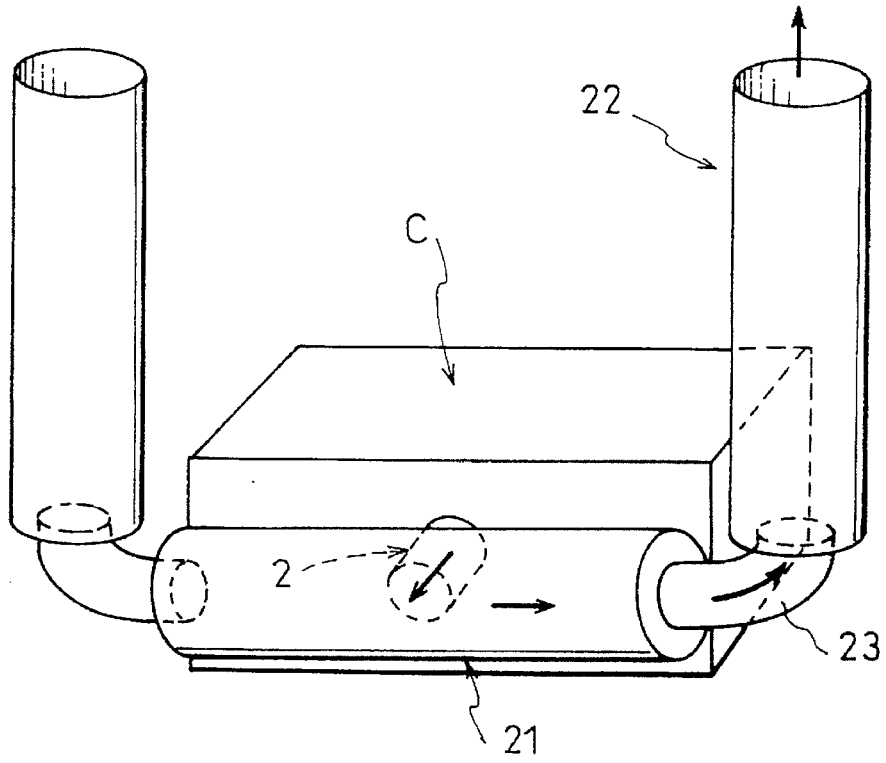
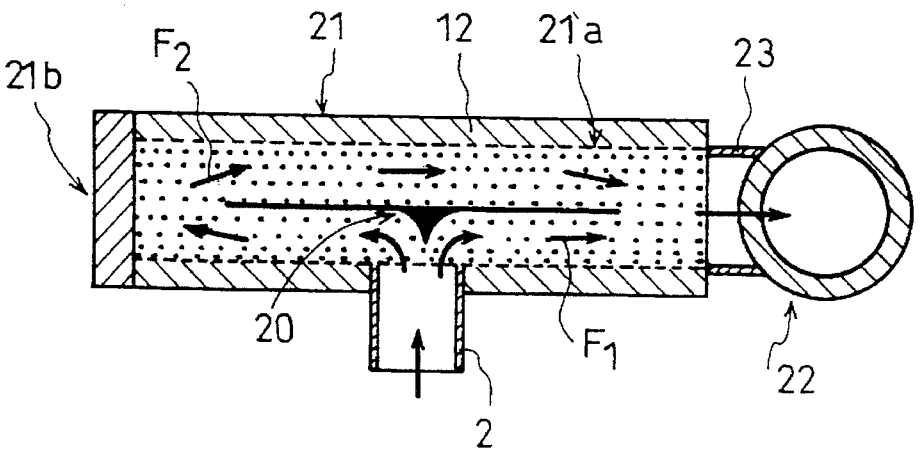
FIG_3

SUCTION DEVICE FOR AN AUTOMATIC CUTTING MACHINE AND A CUTTING METHOD IMPLEMENTING SAID DEVICE

The present invention relates to a suction device for an automatic cutting machine for cutting a stack of sheets, and also to a cutting method using the said device.

Automatic cutting machines generally comprise a cutting table on which there is placed a stack of material in sheet form (cloth, skins, paper, . . . ) to be cut, a cutting tool that is movable over the stack, and a suction device that is generally associated with an impervious film placed on the stack so as to hold the stack down on said table.

The suction device comprises a turbine provided with an air inlet circuit and with an air exhaust circuit, the turbine being driven by an electric motor fitted with a fan. In order to hold the stack of sheet material in place, the above assembly generates significant suction at the top face of the cutting table, with the value of suction under steady conditions being constant. However, depending on the leaks generated by cutting the stack of sheets, the value of the suction varies, decreasing as the amount of leakage increases.

To optimize production and facilitate stack transfer, certain automatic cutting machines are fitted with a conveyor. The conveyor also serves as a cutting zone and it is actuated to advance the material that is to be cut. During such advance, the high degree of suction exerted at the cutting table gives rise to considerable friction which must be overcome, thereby requiring the cutting conveyor to be driven by a motor of high power. To reduce :such conveyor drive forces, certain machines are fitted with a "trap door" system that generates a large amount of leakage at the cutting table so as to reduce the level of suction. Conveyor displacement forces are thus reduced, however this technique generates a large amount of noise.

Whatever the type of automatic cutting machine, the suction device comprising the turbine and its driving electrical motor is generally enclosed in a soundproofed box. Since air flow inside the box is difficult, the high power electric motor heats up considerably and in the long run this can destroy it. Furthermore, old suction devices suffer from the drawback of exhausting hot air into the cutting workshop, and that can be disagreeable for the operators. Furthermore, cutting waste is sucked into the turbine which can degrade its performance.

An object of the present invention is to solve the above technical problems in satisfactory manner. According to the invention, this object is achieved by means of a suction device for holding a stack of sheet material on a cutting table of an automatic cutting machine, the device including a turbine provided with an inlet circuit for air sucked in from the cutting zone to establish suction enabling the stack to be held on the table, and an air exhaust circuit, said turbine being driven by an electric motor fitted with a fan that has an air outlet duct, the device being characterized in that the electric drive motor includes speed varying means for varying its speed of rotation so as to adjust the amount of suction.

In a first embodiment, said speed varying means are constituted by two distinct electrical windings fitted to the motor, thereby producing two different values of suction.

In another embodiment, said speed varying means comprise means for varying the frequency of the electrical power supply to the motor, thereby enabling different values of suction to be obtained.

According to an advantageous characteristic, the device includes exhaust air cooling means that co-operate with additional cooling means for the drive motor.

In a particular embodiment, said exhaust air cooling means are constituted by a junction between the air outlet duct from the fan and the circuit for air exhaust from the turbine and said additional cooling means for the drive motor are constituted by an additional fan mounted on the air outlet duct from the fan of said motor. The junction between the air outlet duct from the additional fan and the air exhaust circuit from the turbine includes a curved internal flap to prevent reverse flows of air.

According to another characteristic, the device is enclosed in a soundproofed box including a suction air inlet orifice, an exhaust air outlet orifice, and two outside air admission orifices, with the exhaust air orifice opening out into one or more silencers in series.

The invention also provides a method of automatically cutting a stack of sheet material placed on a cutting table and using, in particular, a suction turbine provided with a suction air inlet circuit and with an air exhaust circuit, the turbine being driven by an electric motor fitted with fan means for establishing suction beneath said table, the method being characterized in that the speed of rotation of the turbine drive motor is varied so as to adjust the suction in selective manner between cutting stages and stages during which the stack is loaded onto or transferred from the cutting table.

According to an advantageous characteristic of the method, the exhaust air from the turbine and the cooling air from the electric motor are cooled by means of the fan of said motor by injecting air from the motor into the exhaust circuit from the turbine.

According to another characteristic of the method, air from the motor is injected into the exhaust circuit by the Venturi effect and the injection of air into the exhaust circuit is forced by means of an additional fan.

According to yet another characteristic of the method, a low suction value is used for the loading or transfer stage and a high suction value is used for the cutting stage.

The invention thus makes it possible to use a high degree of suction while cutting and a much lower degree of suction while the stack is being advanced and while it is being loaded on the table, while simultaneously reducing the sound level of the machine. This has the advantage of reducing the force required for driving the conveyor and thus of making it possible to use a motor that consumes less electricity. In addition, since the turbine rotates more slowly when the suction is reduced, the machine operates more quietly and its consumption of electricity is also reduced.

When the motor is stopped, and thus when its internal fan is likewise stopped, the additional cooling means for the electrical motor that drives the turbine make it possible to continue ensuring cooling.

Other characteristics and advantages of the present invention appear more clearly on reading the following description of various embodiments of the invention given as non-limiting examples. The description refers to the accompanying drawings, in which:

FIG. 2 is a fragmentary outside view of the device of the invention; and

FIG. 3 is a section view through the exhaust silencers of the device of the invention.

Figure 1:
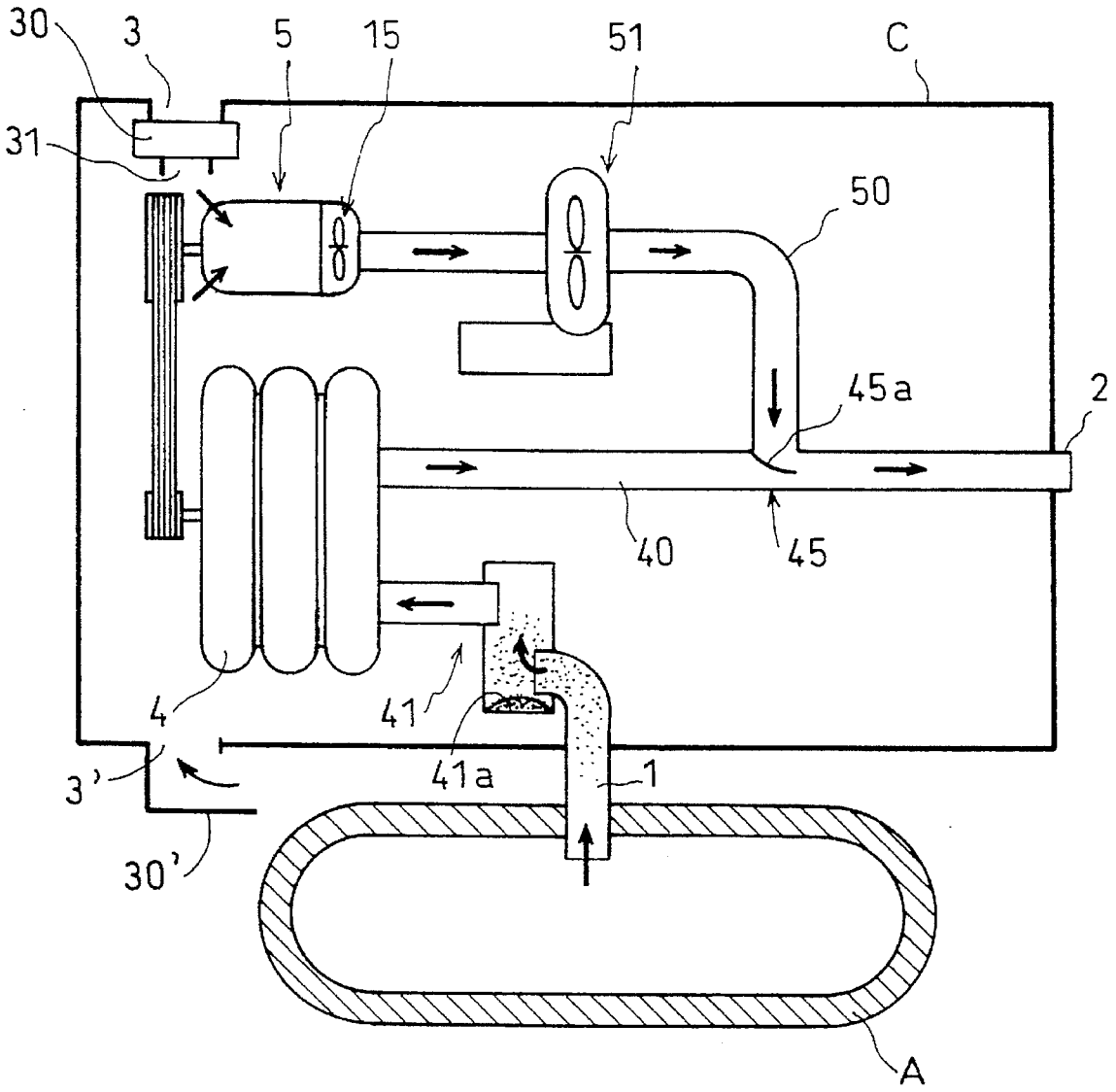
FIG. 1 is a diagrammatic view of the device of the invention while in operation.

The suction device shown in FIG. 1 is enclosed in a soundproofed box C that includes an inlet orifice 1 for air sucked in by a turbine 4 associated with the cutting table or the cutting conveyor A, an outlet orifice 2 for air expelled by said turbine 4, and two outside air admission orifices 3 and 3' disposed on opposite sides of the box C and associated with sound insulating means 30, 30'.

The turbine 4 is provided with a suction air inlet circuit 41 that includes a filter or settling box 41*a* where cutting waste settles out, and an air exhaust circuit 40. The settling box is in the form of a box into which suction air is injected via the bottom and from which it leaves via the top. The air thus flows through the settling box in an upwards direction forming turbulence and heavy dust falls to the bottom of the box under gravity. To increase the turbulence, it is possible to add baffles that reduce the kinetic energy of the dust so as to enhance the effect of gravity. The turbine 4 is driven by an electric motor 5 that is fitted with a fan 15 and with speed varying means. The outside air admission orifice 3 is connected to a duct 31 that opens out inside the box C close to the motor drive shaft 5. The orifices 3 and 3' enable a flow of cool air to be established inside the box C. Whatever the type of turbine chosen, the means for varying the rotary speed of the drive motor must make it possible to obtain at least two different values of suction. The greater value of suction is used to hold down and compress the cloth during cutting. The smaller value of suction is adopted during displacements of the cutting conveyor, i.e. during loading or during transfers. During such displacements, the stack of sheet material must be held together, but too much suction requires the conveyor drive motor to have enough power to overcome the friction generated by the suction between the conveyor and its guide members. A value of suction that is much smaller than that used during cutting suffices to hold the stack of sheet material together and makes it possible to use a conveyor drive motor that is less powerful. The amount of electricity consumed by the machine is thus reduced, and the wear of the conveyor guide elements is also reduced since they are subjected to less force. Also, since the turbine is rotating more slowly, the amount of electricity consumed by the turbine drive motor is also reduced. Furthermore, overall, the cutting machine becomes less noisy. In a first embodiment, the rotary speed of the motor 5 for the turbine 4 is varied by using a drive motor 5 that has two separate windings, thereby generating two different suction values via the turbine 4. Each winding is selected as a function of the desired suction value by a control device fitted with contactors of the relay type, themselves under the control of the numerical control system of the cutting machine.

In another embodiment, the means for varying the speed of rotation of the (single speed) motor 5 comprise means for varying the frequency of the electrical power supply to the said motor 5. By varying the frequency, variations are obtained in the flow rate of air sucked in by the turbine and thus its suction can be varied continuously over a range of values. Under such circumstances, it is possible to adjust suction to specific values in order to improve the quality of cutting.

The device of the invention includes exhaust air cooling means that co-operate with additional means for cooling the motor 5.

The exhaust air cooling means are constituted by a junction 45 between the air outlet duct 50 from the fan and the air exhaust circuit 40 from the turbine.

The additional cooling means for the motor 5 are constituted by an additional fan 51 placed on the air outlet duct 50 from the fan 15.

The purpose of the additional cooling means is to avoid thermal shocks in the drive motor 5 of the turbine 4 and in the air expelled into the duct 40 by the turbine. This air can reach a temperature of 80° C., and that can be harmful to the operators if the air is expelled directly into the cutting workshop. The electric motor is subjected to thermal shocks because the entire suction device is enclosed in the sound-proofed box C. When the high power motor 5 is in operation, there is no problem since its fan 15 is deigned to cool the windings Of the motor. However, there is little air flow inside the suction box C, and when the motor 5 stops, its temperature can reach 120° C., thereby running the risk of damaging its electrical windings.

While it is in operation, the motor is cooled by the air sucked by its own fan 15 and taken from outside the box C. The duct 50 conveys the air picked up from the outlet of the fan 15 of the electric motor 5 and dumps it in the exhaust circuit 40 of the turbine 4.

The additional fan 51 propels air that has passed through the fan 15 into the duct 50 towards its junction 45 with the circuit 40. This additional fan also serves to cool the motor when it has recently been stopped, thereby avoiding thermal shocks. The air coming from the electric motor 5 is at a temperature of about 40° C., it is mixed with the exhaust air from the turbine whose temperature is close to 80° C. After mixing, the air exhausted by the suction device is about 50° C. instead of being about 80° C. Under stable operating conditions, once suction has been established, the turbine operates at a low flow rate to compensate the leaks that are created by the cuts made in the sheet material and the impervious film that helps to hold it down. During this cutting stage, the additional fan 51 operates at a flow rate Q2 that is Greater than the flow rate Q1 of the turbine 1. These two air flows mix properly. When the turbine 4 is used without the cutting zone being covered, its flow rate is much greater than that from the additional fan 51 since suction cannot be established. During this stage, the air coming from the turbine runs the risk of reversing the air flow from the fans 50 to 51 which would subject the electrical motor 5 to harmful consequences. To mitigate that drawback, the junction 45 is fitted where the flows meet with a curved internal flap 45*a* that enables the flows of air to be directed towards the outlet orifice 2 from the box C, and this applies regardless of the flow rate from the turbine 4. Because of its curved shape, the bailer scoop allows air from the turbine to go past while preventing any reversal of air flow coming from the electric motor 5, thereby enhancing a "Venturi" phenomenon whereby the air exhausted by the turbine 4 serves to suck out air from the additional fan 51.

As shown in FIG. 2, the exhaust air outlet orifice 2 from the box C is connected directly to a first exhaust silencer 21 situated horizontally inside the cutting machine and invisible from outside it. This silencer 21 attenuates soundwaves at medium and high frequencies, and also attenuates low frequency waves by establishing a wave phase shift. A second silencer 22, referred to as a "chimney", is suitable for connection in series with either end of the first silencer, depending on which side of the machine it is desired to locate the exhaust chimney. This silencer 22 serves essentially to attenuate medium and high frequency soundwaves by using a material that absorbs sound.

The operation of the silencers 21 and 22 is shown in FIG. 3. Air enters the first silencer 21 via an orifice situated substantially in the middle of the length of the silencer body. The incoming air strikes a splitting metal sheet 20 that subdivides the inside volume of the silencer 21 into two portions that define two distinct paths: a direct path F1 going directly to the second silencer 22, and an indirect path F2 that goes initially towards the closed end of the silencer 21 and whose total length is much greater than that of the path F1. The splitting sheet 20 thus separates the expelled air into two distinct flows F1 and F2, one of which follows a much longer distance than the other before reaching the silencer 22. Sounds propagate in the form of waves, and since the two air flows F1 and F2 enter the silencer 21 simultaneously but leave it one after the other, the difference in path length followed thereby gives rise to a phase shift between the wave lengths of the two flows of air. Since the two soundwaves are no longer in phase, vibrations associated with one of the flows are attenuated by the vibrations of the other flow and the general sound level of the system is reduced. The splitting sheet 20 therefore serves to reduce the sound level of the machine. In order to attenuate noise further, the exhaust silencer 21 is in the form of a tube whose inside longitudinal wall 21*a* is constituted by a perforated metal sheet while the outer longitudinal wall of the tube is constituted by a solid sheet. Sound insulation material 12 is inserted between the two sheets. By way of example, this material may be constituted by foam, by rock wool, or by glass wool. A portion of the soundwaves from the air flows F1 and F2 passes through the holes of the inner perforated sheet 21*a* and is trapped in the insulating material, thereby further attenuating the operating sound level of the device. The second silencer 22 that constitutes the exhaust chimney is made in the same way, but it does not include a splitting sheet 20. This chimney may be fixed to either of the lateral ends of the first silencer 21. Since the shape of the splitting sheet is symmetrical and since the air inlet into the first silencer 21 is situated halfway along it, the principle of soundwave phase shifting remains the same. Regardless of which end of the first silencer 21 has the chimney 22 fixed thereto, the other end of the silencer 21 is closed by an optionally removable plate 21*b* having the same structure as the longitudinal wall. In order to make them easily interchangeable, the fastenings for the lateral endplate 21*b* and for the bend 23 coupling the chimney to the silencer 21 are identical. For example, these fastenings may be implemented merely in the form of holes that receive bolts screwed into the ends of the silencer 21. The two silencers 21 and 22 in series make it possible to reduce sound levels by about 20 dBa. In addition, the silencers 21 and 22 may be connected directly to a duct for exhausting air outside the building in which the cutting machine is located.

I claim:

1. A suction device for holding a stack of sheet material on a cutting table of an automatic cutting machine, comprising:

a turbine having an air exhaust circuit for air exhaust from said turbine and an inlet circuit for air sucked in from a cutting zone to establish suction enabling said stack to be held on said cutting table;

an electric drive motor for driving said turbine, said electric drive motor fitted with a first fan, said first fan having an air outlet duct, said electric drive motor having a speed varying means for varying the speed of rotation of said electric drive motor so as to adjust the amount of suction; and a junction between said air outlet duct and said air exhaust circuit, said junction having a curved internal flap to prevent reverse flow of air.

2. A device according to claim 1, wherein said device further comprises an additional cooling means for said electric drive motor.

3. A device according to claim 2, wherein said junction between said air outlet duct and said air exhaust circuit forms an exhaust air cooling means, said exhaust air cooling means cooperating with said additional cooling means for said electric drive motor.

4. A device according to claim 2, wherein said additional cooling means for said electric drive motor comprises a second fan mounted on said air outlet duct from said first fan of said electric drive motor.

* * * * *